US005083340A

United States Patent [19]

Takahashi et al.

[11] Patent Number: 5,083,340

[45] Date of Patent: Jan. 28, 1992

[54] NOZZLE PIPE SUPPORTING HANDLE

[75] Inventors: Kazunori Takahashi, Kawagoe; Giichi Iida, Tokyo, both of Japan

[73] Assignee: Kioritz Corporation, Tokyo, Japan

[21] Appl. No.: 696,648

[22] Filed: May 7, 1991

[30] Foreign Application Priority Data

May 9, 1990 [JP] Japan ..... 2-048376[U]

[51] Int. Cl.[5] ..... A47L 9/32

[52] U.S. Cl. ..... 15/410; 15/405; 15/418

[58] Field of Search ..... 15/405, 344, 410

[56] References Cited

U.S. PATENT DOCUMENTS

| | | | |
|---|---|---|---|
| 3,147,510 | 9/1964 | Thompson | 15/410 X |
| 3,586,238 | 6/1971 | Schmierer et al. | 239/153 |
| 3,971,098 | 7/1976 | Davis | 15/410 |
| 4,121,320 | 10/1978 | Feiner | 15/410 X |
| 4,223,419 | 9/1980 | Sato et al. | 15/405 X |
| 4,269,571 | 5/1981 | Shikutani et al. | 417/234 |
| 4,413,371 | 11/1983 | Tuggle et al. | 15/405 |
| 4,657,477 | 4/1987 | Shinada | 15/410 X |

FOREIGN PATENT DOCUMENTS

| | | |
|---|---|---|
| 52-52574 | 4/1977 | Japan . |
| 54-23881 | 2/1979 | Japan . |
| 151477 | 10/1983 | Japan . |

*Primary Examiner*—Chris K. Moore

*Attorney, Agent, or Firm*—Browdy and Neimark

[57] ABSTRACT

A nozzle pipe supporting handle comprises flange portions disposed at both sides of a slit of a mounting portion, wherein the inner sides of the flange portions are press-fitted to the outer sides of a grip portion so that the grip portion can be held in such a manner that the mounting position thereof can be changed relative to a nozzle pipe.

1 Claim, 3 Drawing Sheets

NOZZLE PIPE SUPPORTING HANDLE

BACKGROUND OF THE INVENTION

The present invention relates to a nozzle pipe supporting handle for a chemical sprayer, an air blowing cleaner or the like.

There are demands for nozzle pipe supporting handles for chemical sprayers, air blowing cleaners and the like to have a handle grip portion which can be changed in its mounting position such as an angle or the like according to the state wherein the handle is used by the operator. However, in conventional nozzle pipe supporting handles, when the mounting position of the handle grip portion is changed, the screws for fixing the grip portion are loosened by using a tool, and the position is then adjusted. The conventional supporting handles therefore have the disadvantage that much time is required for changing the mounting position of the grip portion.

SUMMARY OF THE INVENTION

Accordingly, the present invention had been achieved for removing the disadvantage of the prior art, and it is an object of the present invention to provide a nozzle pipe supporting handle which permits the handle grip portion to be rapidly and easily changed in its mounting position.

Namely, a nozzle pipe supporting handle in accordance with the present invention comprises a mounting portion wound round a nozzle pipe and having a slit formed therein, flange portions disposed at both sides of the slit, hollow shaft portions formed integrally with the flange portions so as to coaxially extend therebetween, a grip portion pivotally supported by the shaft portions, a screw member which has a thumbscrew portion being in contact with one of the flange portions and which is passed through the inside of the shaft portion and extends to the other flange portion, and a nut member which is in contact with the other flange portion and which is screwed on the end of the screw member, wherein the inner sides of the flange portions are press fitted to the outer sides of the grip portion by tightening the screw portion so that the grip portion can be held on the nozzle pipe in such a manner that the mounting position of the grip portion can be changed.

The present invention thus provides a nozzle pipe supporting handle with a simple structure which can be easily produced and which permits the grip portion to be easily changed in its angle or the like by rotating the thumbscrew portion of the screw member with the hand, without using any tool.

DESCRIPTION OF PREFERRED EMBODIMENT OF THE INVENTION

The present invention is described below with reference to an embodiment.

Figure 1:
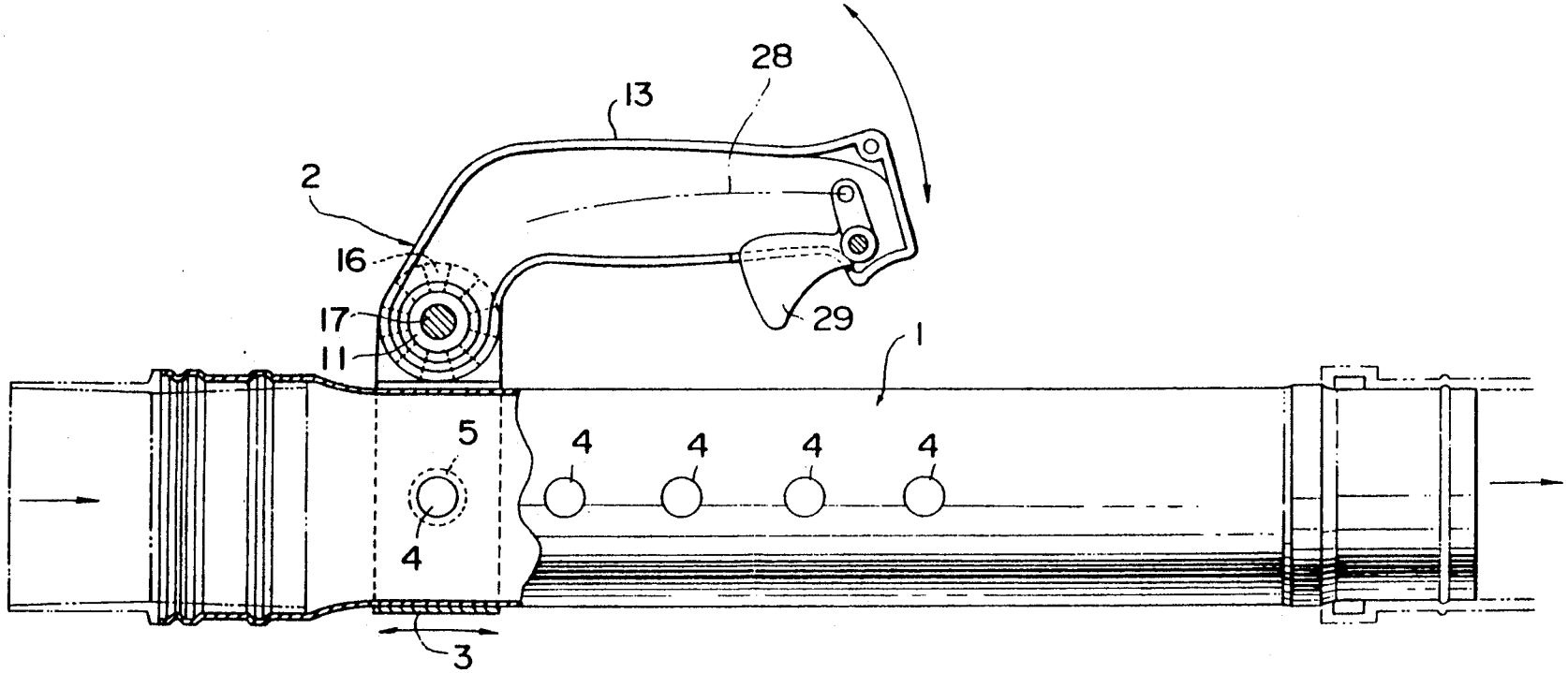
FIG. 1 is a sectional side view of a principal portion of a nozzle pipe supporting handle in accordance with an embodiment of the present invention.

The embodiment shown in the drawings is applied to an air blowing cleaner (power blower). As shown in FIG. 1, the cylindrical mounting portion 3 of a nozzle pipe supporting handle 2 is wound hound a nozzle pipe 1 connected to the discharge port (not shown) of the blower. The nozzle pipe 1 has a plurality of protruding portions 4 which are formed at both sides of the outer periphery of the nozzle pipe 1 integrally therewith so as to be arranged at certain intervals in the axial direction of the nozzle pipe 1. On the other hand, the mounting portion 3 of the nozzle pipe supporting handle 2 has one recess 5 formed in each of the side portions of the inner periphery thereof. When the recesses 5 are respectively engaged with the corresponding protruding portions 4 in the side portions of the nozzle pipe 1, the nozzle pipe supporting handle 2 can be positioned so as not to be easily moved relative to the nozzle pipe 1.

Figure 2:
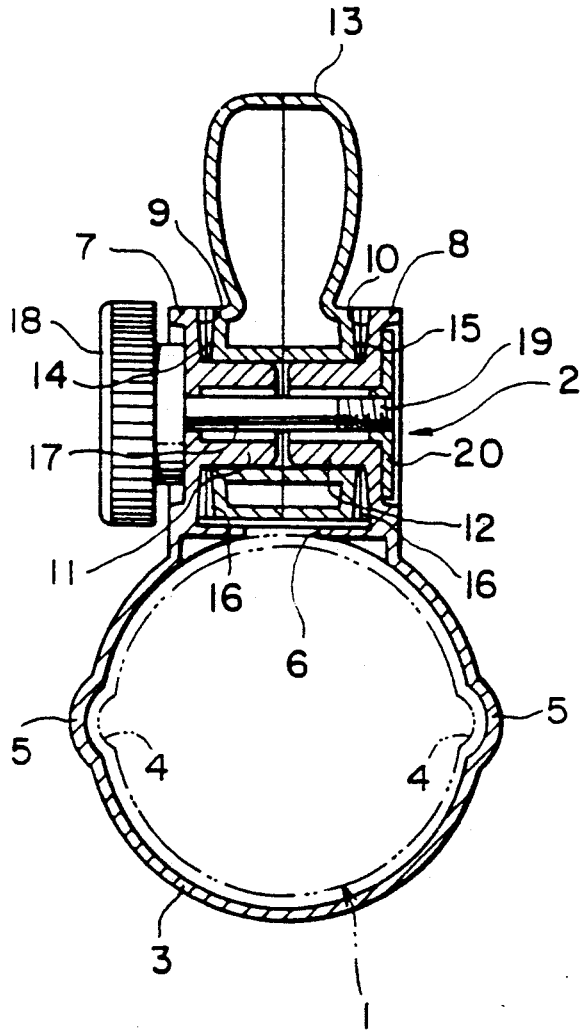
FIG. 2 is a cross-sectional view of the nozzle pipe supporting handle in the embodiment shown in FIG. 1.

The mounting portion 3 of the nozzle pipe supporting handle 2 is integrally formed by using a relatively elastic synthetic resin material and, as shown in FIG. 2, it has a slit 6 formed in an upper portion thereof and extending in the axial direction of the nozzle pipe 1. The provision of the slit 6 causes the mounting portion 3 to be outwardly and elastically deflected in the radial direction thereof and the nozzle pipe 1 to be securely held, thereby securely fixing both members. The provision of the slit 6 also causes a reduction in the holding force on the nozzle pipe 1 and thus causes the position of the nozzle pipe supporting handle 2 relative to the nozzle pipe 1 to be easily adjusted.

The mounting portion 3 of the nozzle pipe supporting handle 2 has flange portions 7 and 8 which are outwardly extended at both sides of the slit 6 and which is formed integrally with the mounting portion 3. The both flange portions 7 and 8 respectively have hollow shaft portions 11 and 12 which are inwardly and coaxially extend from the inner sides 9 and 10 in the opposite directions and which are formed integrally with the flange portions 7 and 8, respectively. The shaft portions 11 and 12 are disposed at an appropriate distance between the inner ends thereof. The grip portion 13 of the nozzle pipe supporting handle 2 is supported by the outer peripheries of the shaft portions 11 and 12 so as to be slidable in the plane including the axis of the nozzle pipe 1. The grip portion 13 has two parts made of a synthetic resin material having an appropriate degree of elasticity. The outer sides 14 and 15 of the grip portion 13 are disposed near the inner sides 9 and 10, respectively, of the left and right flange portions 7 and 8 of the mounting portion 3. An inner clip washer surface 16 is formed on each of the inner sides 9 and 10 of the flange portion 7 and 8 and the left and right outer sides 14 and 15 of the grip portion 13.

The mounting portion 3 of the nozzle pipe supporting handle 2 also has a screw member 17 which are extended from the left flange portion 7 toward the right flange portion 8 while being passed through the insides of the shaft portions 11 and 12. The screw member 17 has a thumbscrew portion 18 which is formed at one end thereof and which contacts with the outer side of the left flange portion 7, the tip portion 19 of the screw member 17 being screwed into a plate-shaped nut member 20 contacting with the outer side of the right flange portion 8 so that its rotation is prohibited. The screw member 17 is screwed into the nut member 20 by rotating the thumbscrew portion 18 with the hand in the tightening direction so that the mounting portion 3 is securely tightened around the nozzle pipe 1. This causes the nozzle pipe supporting handle 2 to be prevented from moving relative to the nozzle pipe 1 and the inner sides 9 and 10 of the flange portions, respectively, to be press-fitted to the outer sides 14 and 15 of the grip portion 13. The inner clip washer surface 16 respectively formed on the inner sides 9, 10 and the outer sides 14, 15 are thus engaged with each other so as to certainly prevent the grip portion 13 from pivotally moving relative to the mounting portion 3. When the screw member 17 is loosened by rotating the thumbscrew portion 18 with the hand in the reverse direction, the grip portion 13 can be pivotally moved, and the nozzle pipe supporting handle 2 can be moved relative to the nozzle pipe 1 along the axial direction thereof, whereby the nozzle pipe supporting handle 2 can be positioned at another position again.

It is preferable that the molded shape of the mounting portion 3 is previously designed so that slit 6 expands of itself when the screw member 17 is loosened.

Figure 3:
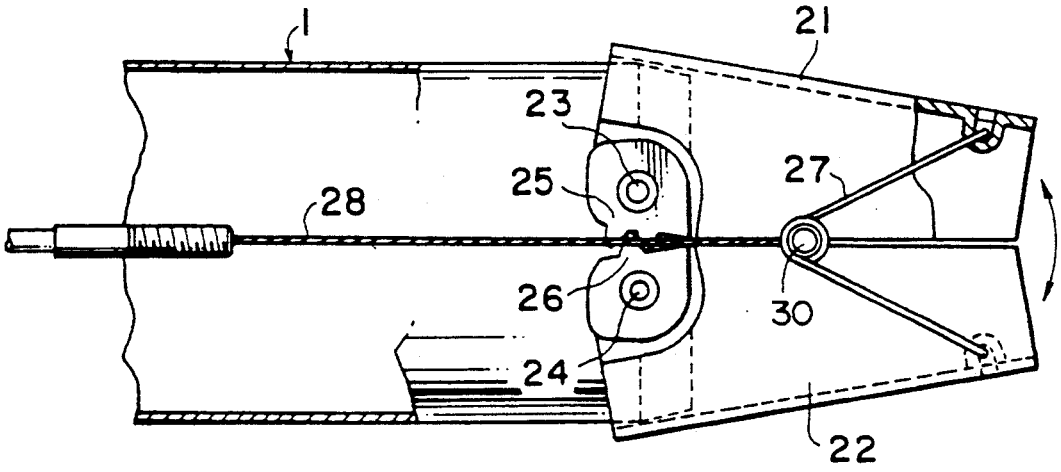
FIG. 3 is a sectional side view of a principal portion of the end portion of the nozzle pipe in the embodiment shown in FIG. 1.
Figure 4:
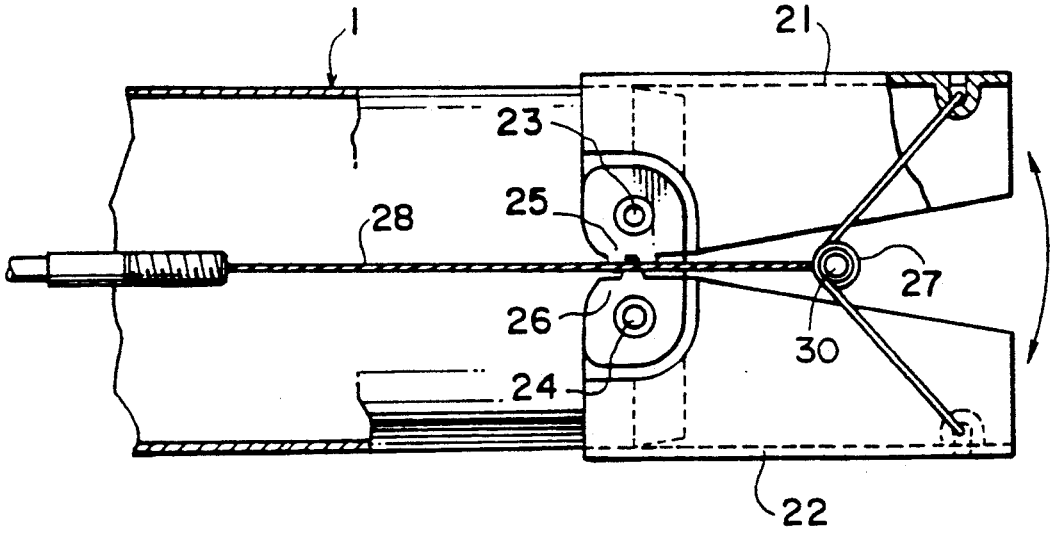
FIG. 4 is a sectional side view of a principal portion in another state of the end portion of the nozzle pipe in the embodiment shown in FIG. 1.

For example, in the case of a blast cleaner, as shown in FIGS. 3 and 4, the nozzle pipe 1 has semi-cylindrical nozzle members 21, 22 which are pivotally provided by means of support shafts 23, 24, respectively. The nozzle members 21, 22 are engaged with each other by tooth portions 25 and 26 engaged with each other so that the nozzle members 21, 22 can be pivotally rotated from the minimum opening position shown in FIG. 3 to the maximum opening position shown in FIG. 4. In a normal state, the nozzle members 21, 22 are biased toward the maximum opening position shown in FIG. 4 by a torsion spring 27 provided therebetween. An engaging piece 30 provided at one end of a Bowden cable 28 is engaged with the central portion of the spring 27. The Bowden Cable 28 is backwardly extended along the nozzle pipe 1, passed through the inside of the grip portion 13 and engaged with the inner end of a trigger member 29 pivotally provided at the end of the grip portion 13. The outer end of the trigger member 29 outwardly projects from the grip portion 13 so that the nozzle members 21, 22 can be moved toward the minimum opening portion shown in FIG. 3 when the trigger member 29 is pressed by the operator to pull the Bowden cable 28 during work, whereby the force of the air blown from the nozzle pipe 1 can be adjusted.

As a matter of course, the trigger member 29 can be used for controlling the throttle of a prime mover and other purposes.

What is claimed is:

1. A nozzle pipe supporting handle comprising a mounting portion wound round a nozzle pipe and having a slit, flange portions disposed as both sides of said slit, hollow portions which are respectively formed integrally with said flange portions and which coaxially extend between said flange portions, a grip portion pivotally supported by said shaft portions, a screw member which has a thumbscrew portion contacting with one of said flange portions and which is passed through the insides of said shaft portions and extends to the other flange portion, and a nut member which contacts with said other flange portion and which is screwed on the tip portion of said screw member, wherein the inner sides of said both flange portions are press-fitted to the outer sides of said grip portion by tightening said screw member so that said grip portion can be held in such a manner that the mounting position of said grip portion can be changed relative to said nozzle pipe.

* * * * *